US011882935B2

(12) United States Patent
Moore

(10) Patent No.: US 11,882,935 B2
(45) **Date of Patent: *Jan. 30, 2024**

(54) HEIGHT-ADJUSTABLE DESK

(71) Applicant: Mateo Goods Co., Tempe, AZ (US)

(72) Inventor: Matthew Jason Moore, Phoenix, AZ (US)

(73) Assignee: Mateo Goods Co., Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/180,542

(22) Filed: Mar. 8, 2023

(65) Prior Publication Data

US 2023/0218078 A1 Jul. 13, 2023

Related U.S. Application Data

(63) Continuation of application No. 17/504,195, filed on Oct. 18, 2021, now Pat. No. 11,617,433.

(Continued)

(51) Int. Cl.
*A47B 9/20* (2006.01)
*A47B 21/04* (2006.01)

(Continued)

(52) U.S. Cl.
CPC ..... *A47B 9/20* (2013.01); *A47B 9/04* (2013.01); *A47B 21/02* (2013.01); *A47B 21/04* (2013.01);

(Continued)

(58) Field of Classification Search
CPC .. A47B 9/20; A47B 9/04; A47B 21/02; A47B 21/04; A47B 2200/0062; A47B 2200/0084; A47B 2200/0058

(Continued)

(56) References Cited

U.S. PATENT DOCUMENTS

D216,204 S 6/1879 McCormick
D128,791 S 8/1941 Ullery (Continued)

FOREIGN PATENT DOCUMENTS

CA 2348060 11/2002
CA 2840843 12/2013

(Continued)

OTHER PUBLICATIONS

All Sit / Sitstand Desks by Mateo Goods, first available: Unknown. hellomateogoods.com [online], [site visited Apr. 13, 2022], Internet URL: https://hellomateogoods.com/collections/all (Year: 2022) 1 page.

(Continued)

*Primary Examiner* — Jose V Chen

(74) *Attorney, Agent, or Firm* — Esplin & Associates, PC

(57) ABSTRACT

A height-adjustable desk is disclosed. Exemplary implementations may include a work surface, a left-side support structure, a right-side support structure, a core body, and a working body that provides the work surface. The core body may include lifting mechanisms such that the work surface of the desk may be positioned for a person in a standing and/or sitting position. The working body may include a control interface configured to be manually engaged by the user, to control lifting and/or lowering of the work surface of the desk.

16 Claims, 13 Drawing Sheets

Related U.S. Application Data

(60) Provisional application No. 63/129,297, filed on Dec. 22, 2020.

(51) Int. Cl.
*A47B 21/02* (2006.01)
*A47B 9/04* (2006.01)

(52) U.S. Cl.
CPC ..... *A47B 2200/0058* (2013.01); *A47B 2200/0062* (2013.01); *A47B 2200/0084* (2013.01)

(58) Field of Classification Search
USPC ..... 108/147, 180, 157.14, 50.01
See application file for complete search history.

(56) References Cited

U.S. PATENT DOCUMENTS

| | | | |
|---|---|---|---|
| 2,560,957 | A | 7/1951 | Johnson |
| D164,584 | S | 9/1951 | Koegel |
| 2,636,224 | A | 4/1953 | Murdoch |
| 3,113,531 | A | 12/1963 | Barnard |
| D208,256 | S | 8/1967 | Rich |
| D243,192 | S | 1/1977 | Clayton |
| D243,300 | S | 2/1977 | Christensen |
| D258,789 | S | 4/1981 | Verdesca |
| D260,716 | S | 9/1981 | Cohen |
| D261,713 | S | 11/1981 | Curatolo |
| D262,763 | S | 1/1982 | Lerner |
| D262,846 | S | 2/1982 | Chaiken |
| D267,690 | S | 1/1983 | Verdesca |
| D278,583 | S | 4/1985 | Koguma |
| D282,023 | S | 1/1986 | Sottsass |
| D285,394 | S | 9/1986 | Curran |
| D286,832 | S | 11/1986 | Matthews |
| 4,651,652 | A | 3/1987 | Wyckoff |
| 4,668,026 | A | 5/1987 | Lapeyre |
| D297,987 | S | 10/1988 | Borsos |
| 4,790,611 | A | 12/1988 | Craner |
| D305,585 | S | 1/1990 | Wright |
| D305,838 | S | 2/1990 | Bienenstock |
| 4,969,403 | A | 11/1990 | Schwartz |
| 4,987,835 | A | 1/1991 | Schwartz |
| D314,289 | S | 2/1991 | Schaelling |
| 5,083,514 | A | 1/1992 | Schwartz |
| D330,469 | S | 10/1992 | Brodbeck |
| D340,816 | S | 11/1993 | Lee |
| D345,062 | S | 3/1994 | Brandon |
| 5,322,025 | A | 6/1994 | Sherman |
| 5,363,775 | A | 11/1994 | Simpson |
| D368,812 | S | 4/1996 | Lee |
| 5,544,593 | A | 8/1996 | Canfield |
| 5,720,185 | A | 2/1998 | Lee |
| D393,958 | S | 5/1998 | Moncourtois |
| 5,791,265 | A | 8/1998 | Ellsworth |
| D399,683 | S | 10/1998 | Nicklas |
| 6,070,956 | A | 6/2000 | Yates |
| D441,566 | S | 5/2001 | Martin |
| 6,286,441 | B1 | 9/2001 | Burdi |
| 6,398,326 | B1 | 6/2002 | Wang |
| D473,728 | S | 4/2003 | Chang |
| 6,708,627 | B1 | 3/2004 | Wood |
| D489,200 | S | 5/2004 | Antonioni |
| D496,183 | S | 9/2004 | Savage |
| 6,796,247 | B1 | 9/2004 | Iglseder |
| D516,340 | S | 3/2006 | Chang |
| D538,068 | S | 3/2007 | Newhouse |
| D546,103 | S | 7/2007 | Eyman |
| D552,900 | S | 10/2007 | Wilenius |
| 7,331,296 | B1 | 2/2008 | Wood |
| 7,398,738 | B2 | 7/2008 | Newhouse |
| D596,876 | S | 7/2009 | Oshinomi |
| D610,840 | S | 3/2010 | Kato |
| 7,789,251 | B1 | 9/2010 | Clark |
| 7,866,622 | B2 | 1/2011 | Dittmer |
| 7,975,626 | B1 | 7/2011 | Wang |
| D647,324 | S | 10/2011 | Kincaid |
| D653,862 | S | 2/2012 | Hairston |
| D677,943 | S | 3/2013 | Mendoza |
| D724,364 | S | 3/2015 | Demars |
| 8,985,032 | B1 | 3/2015 | Johnson |
| D730,658 | S | 6/2015 | Dillon |
| 9,277,806 | B2 | 3/2016 | Hallman |
| D761,577 | S | 7/2016 | Agati |
| D773,219 | S | 12/2016 | Clouse |
| 9,593,481 | B2 | 3/2017 | Gosling |
| D788,496 | S | 6/2017 | Yamamoto |
| 9,723,919 | B1 | 8/2017 | Randolph |
| 9,980,559 | B2 | 5/2018 | Randolph |
| 10,034,538 | B1 | 7/2018 | Masters |
| D853,759 | S | 7/2019 | Moore |
| D863,833 | S | 10/2019 | Moore |
| 10,561,233 | B1 | 2/2020 | Lin |
| 10,701,067 | B1 | 6/2020 | Ziraknejad |
| 10,939,752 | B2 | 3/2021 | Moore |
| 11,589,673 | B1 * | 2/2023 | Moore ..... A47B 9/00 |
| 11,617,433 | B1 * | 4/2023 | Moore ..... A47B 9/04 108/106 |
| 2002/0050234 | A1 | 5/2002 | Lechman |
| 2004/0123782 | A1 | 7/2004 | Korber |
| 2004/0173125 | A1 | 9/2004 | Chang |
| 2004/0237852 | A1 | 12/2004 | Tsai |
| 2005/0016080 | A1 | 1/2005 | Williams |
| 2006/0185564 | A1 | 8/2006 | Stengel |
| 2006/0230992 | A1 | 10/2006 | Newhouse |
| 2007/0044692 | A1 | 3/2007 | Zimmer |
| 2008/0018211 | A1 | 1/2008 | Dye |
| 2008/0284292 | A1 | 11/2008 | Castelluccio |
| 2008/0284293 | A1 | 11/2008 | Martin |
| 2009/0094913 | A1 | 4/2009 | Singh |
| 2015/0319161 | A1 | 11/2015 | Dimmick |
| 2016/0128469 | A1 | 5/2016 | Matthai |
| 2016/0260019 | A1 | 9/2016 | Riquelme Ruiz |
| 2016/0353876 | A1 | 12/2016 | Mitchell |
| 2016/0360879 | A1 | 12/2016 | Kelley |
| 2017/0251806 | A1 | 9/2017 | Newman |
| 2018/0168334 | A1 | 6/2018 | Swartz |
| 2018/0360207 | A1 | 12/2018 | Neudeck |
| 2019/0023298 | A1 | 1/2019 | Carzola |
| 2019/0125075 | A1 | 5/2019 | Soulliere |
| 2019/0172025 | A1 | 6/2019 | Vieri |
| 2019/0223586 | A1 | 7/2019 | Hansen |
| 2019/0374023 | A1 | 12/2019 | Allen |
| 2020/0178683 | A1 | 6/2020 | O'Gara |
| 2020/0297269 | A1 | 9/2020 | Vieri |
| 2020/0329860 | A1 | 10/2020 | Xiang |
| 2020/0329861 | A1 | 10/2020 | Zhang |
| 2021/0011453 | A1 | 1/2021 | Xiang |
| 2021/0342822 | A1 | 11/2021 | Lau |
| 2022/0031062 | A1 | 2/2022 | Albert |
| 2022/0218102 | A1 | 7/2022 | Isgar |
| 2022/0273094 | A1 | 9/2022 | Wallis |
| 2023/0101814 | A1 | 3/2023 | Knock |
| 2023/0218077 | A1 | 7/2023 | Moore |

FOREIGN PATENT DOCUMENTS

| | | |
|---|---|---|
| GB | 2362822 | 12/2001 |
| WO | 2016195853 | 12/2016 |

OTHER PUBLICATIONS

The Sit Desk by Mateo Goods, first available: Unknown. hellomateogoods.com [online], [site visited Apr. 13, 2022], Internet URL: https://hellomateogoods.com/collections/all/products/the-static-desk (Year: 2022) 1 page.

The Sit-Stand Desk by Mateo Goods, first available: Sep. 26, 2020. Indiegogo.com [online], [site visited Apr. 13, 2022], Internet URL:https://

(56) References Cited

OTHER PUBLICATIONS www.indiegogo.com/projects/the-sit-stand-desk-by-mateo#/ (Year:: 2020) 2 pages.

* cited by examiner

HEIGHT-ADJUSTABLE DESK

FIELD OF THE DISCLOSURE

The present disclosure relates to a height-adjustable desk.

BACKGROUND

Desks are known, typically as work surfaces for people at a fixed height. Height-adjustable desks are known, typically the legs on the left side and right side provide the lifting mechanisms used to lower and raise some part of the desks.

SUMMARY

One aspect of the present disclosure relates to a height-adjustable desk configured to be positioned for a person (i.e., a user) in a sitting and/or standing position. The desk may be configured to be lifted and/or lowered by lifting mechanisms positioned at the desk's rear side. As used herein, relative positional terms including but not limited to rear side, front side, left side and right side may refer to the point of view of a user positioned at the desk in a common fashion. The lifting mechanisms may have no direct contact with the ground and may be coupled to support structures. The lifting mechanism may be configured to stabilize the desk when lifted, lowered, and when the desk is in use. Traditionally, height-adjustable desks offer stability of the desk by virtue of lifting mechanisms. These traditional desks may position their lifting mechanisms at sides of the desk with no extra support structure(s). Traditional desks may have different undesirable features. By way of non-limiting example, these traditional desks may allow for forward or backward flexing due to lack of extra support structures for desk stability. As described by the present disclosure, the height-adjustable desk may provide different improvements and/or advantages, including but not limited to improved stability.

As used herein, any association (or relation, or reflection, or indication, or correspondency) involving desk parts, surfaces, support structures, bodies, openings, cavities, stiles, actuators, motors, columns, arms, housings, couplings, interfaces, buttons, and/or another entity or object that interacts with any part of the height-adjustable desk, may be a one-to-one association, a one-to-many association, a many-to-one association, and/or many-to-many association or "N"-to-"M" association (note that "N" and "M" may be different numbers greater than 1).

As used herein, the term "detect" (and derivatives thereof) may include active determination, realization, and conclusion of user input, and/or any combination thereof. As used herein, the term "control" (and derivatives thereof) may include active and/or passive effectuation, and causation of a response to user input, and/or any combination thereof. As used herein, the term "adjustably coupled" (and derivatives thereof) may include temporary and/or permanent fastening, joining, assembling, combining, and/or uniting of desk parts, and/or any combination thereof.

These and other features and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1A:
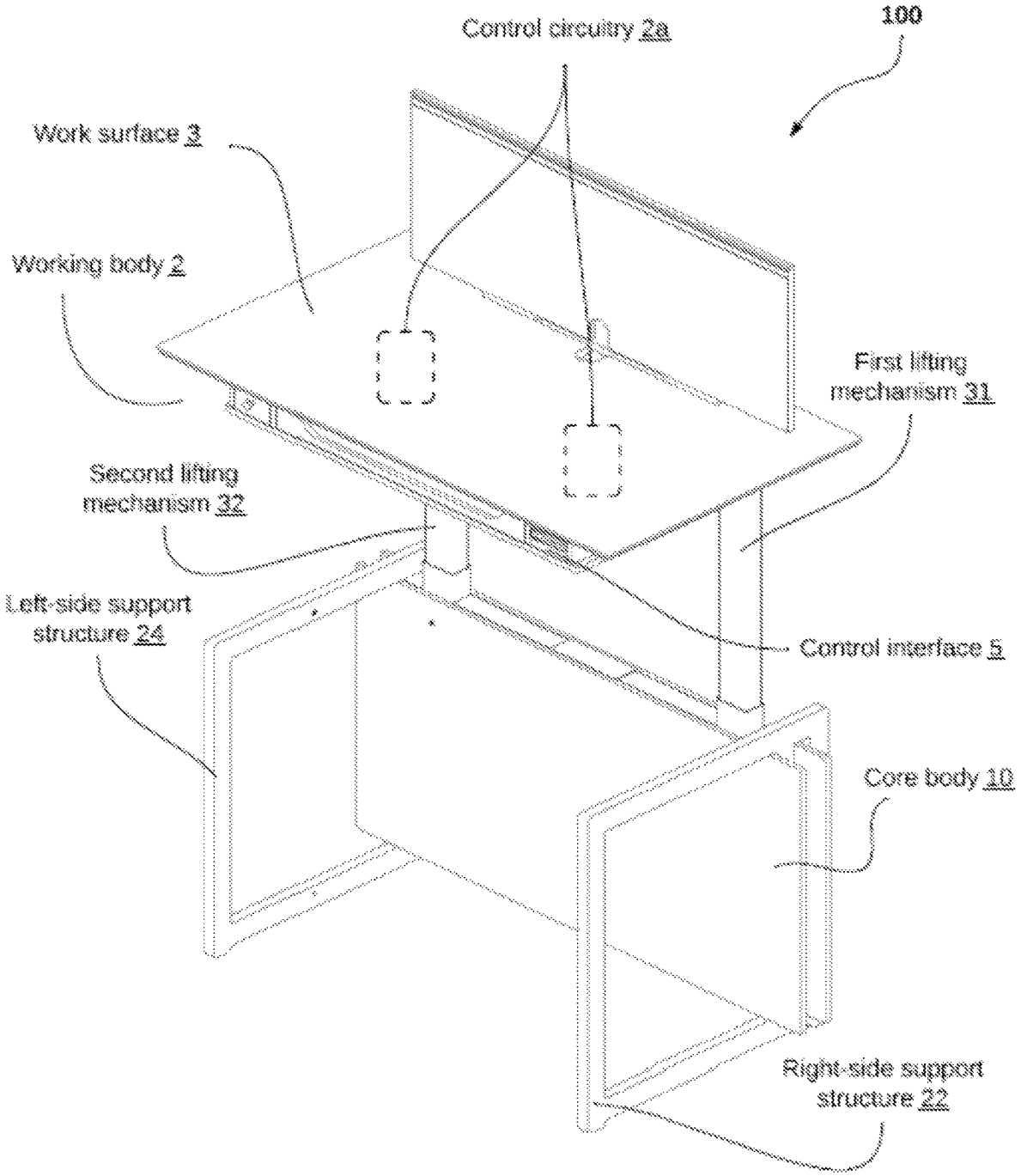
FIG. 1A shows an assembled view of a height-adjustable desk in its lifted position, in accordance with one or more implementations.

FIG. 1A shows a height-adjustable desk 100 (hereinafter desk 100) configured to be positioned for a user in a sitting position and/or standing position, in accordance with one or more implementations. FIG. 1A shows desk 100 in a standing and/or lifted position. Desk 100 may include one or more of a working body 2, a control circuitry 2*a*, a work surface 3, a control interface 5, a core body 10, a left-side support structure 24, a right-side support structure 22, a first lifting mechanism 31, a second lifting mechanism 32, and/or other components. Left-side support structure 24 and right-side support structure 22 may be configured to be coupled to core body 10 to provide the entire desk stability while being raised, lowered, and/or in use. First lifting mechanism 31 and second lifting mechanism 32 may be coupled to core body 10 and working body 2. By way of non-limiting example, other components may be configured for the desk as there may be preferences by users to customize the desk to their likings.

Figure 1B:
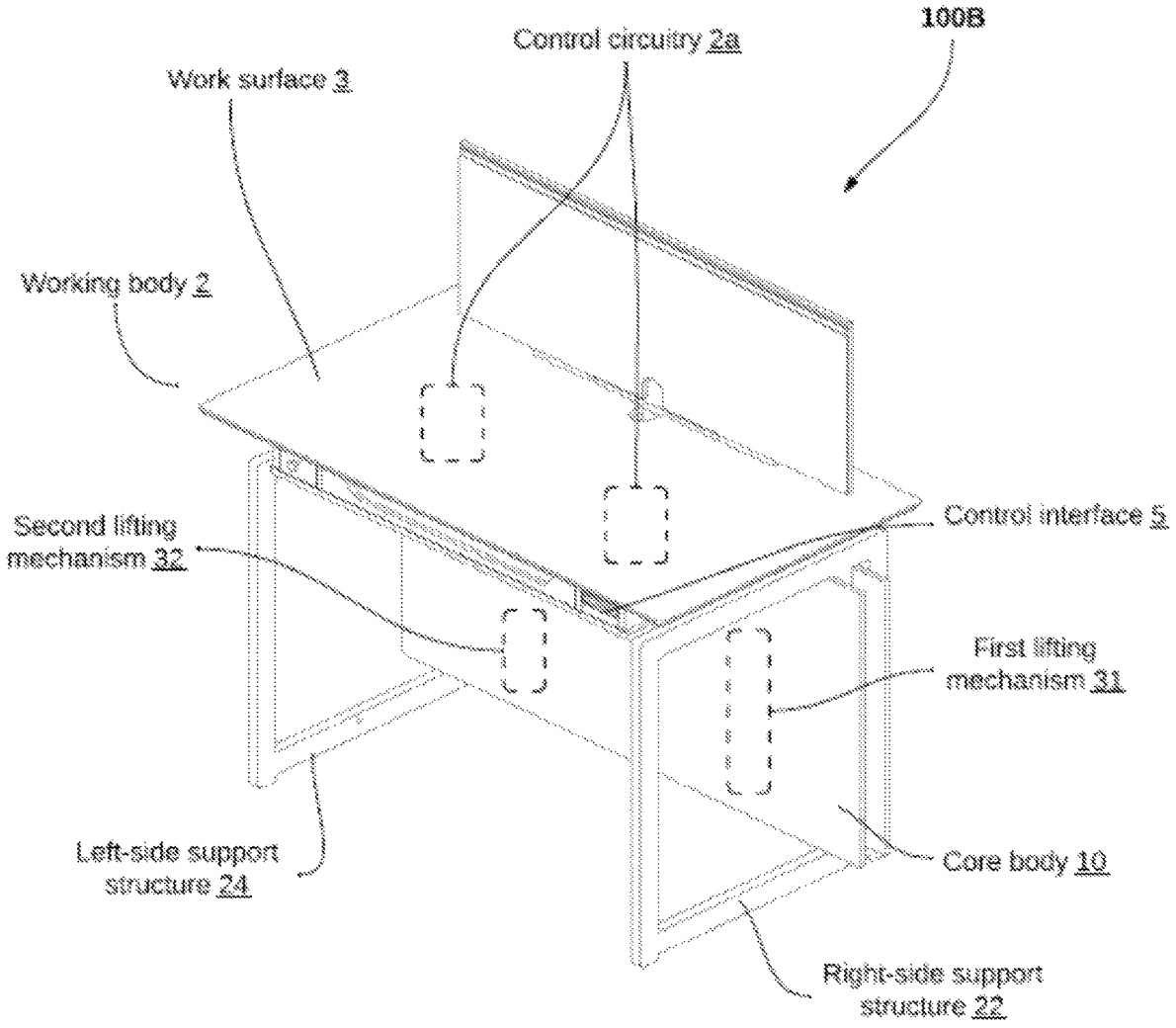
FIG. 1B shows an assembled view of a height-adjustable desk in its lowered position, in accordance with one or more implementations.

FIG. 1B shows an isometric elevated view 100B of a height-adjustable desk in a sitting and/or lowered position. In this position, first lifting mechanism 31 and second lifting mechanism 32 may be (at least partially) housed within core body 10. In some implementations, in this position, first lifting mechanism 31 and second lifting mechanism 32 may be mostly hidden from view.

Figure 1C:
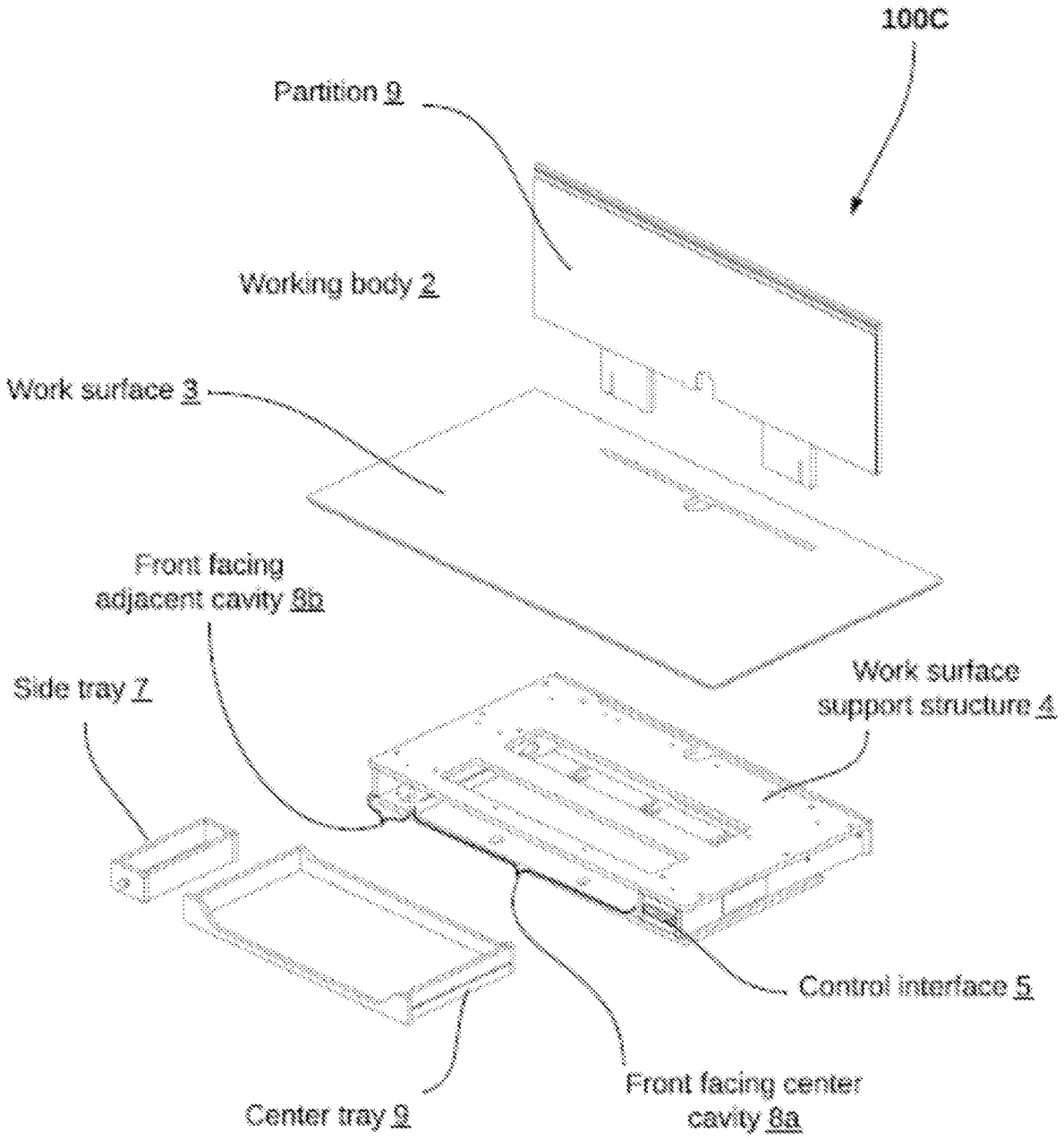
FIG. 1C shows a disassembled and/or exploded view of a working body of a height-adjustable desk, in accordance with one or more implementations.

Working body 2 may be configured to include a work surface 3 coupled to a work surface support structure 4 as shown in FIG. 1C. Working body 2 may be configured to adjustably couple to first lifting mechanism 31 (FIG. 1A) and second lifting mechanism 32 (FIG. 1A). Working body 2 may be configured to be supported by core body 10 at a rear side of desk 100 by virtue of core body 10 being coupled to first lifting mechanism 31 (FIG. 1A), second lifting mechanism 32 (FIG. 1A), right-side support structure 22 (FIG. 1A), and left-side support structure 24 (FIG. 1A).

Work surface 3 of desk 100 may be disposed at a current height. The current height may be adjustable. In some implementations, the adjustments in the current height of work surface 3 may have a vertical range of about 20 inches. In some implementations, the adjustments in the current height of work surface 3 may have a vertical range between about 15 inches and 25 inches. In some implementations, the adjustments in the current height of work surface 3 may have a vertical range between about 18 inches and 24 inches. In some implementations work surface 3 of working body 2 may have a surface area ranging from 46 inches to 52 inches in width. In some implementations work surface 3 of working body 2 may have a surface area of about 26 inches deep. In some implementations work surface 3 of working body 2 may have a surface area ranging between about 22 and about 30 inches deep.

By way of non-limiting example, FIG. 1C shows a work surface support structure 4 which may include a control interface 5, a front facing center cavity 8*a*, a front facing adjacent cavity 8*b*, and/or other components. In some implementations, control interface 5 may be configured to receive user input from the user. The location of control interface 5 on the desk is not limited by its exemplary illustration in FIG. 1C, which is merely meant to represent a convenient position for users to engage with control interface 5 to adjust the current height of work surface 3. By way of non-limiting example, control interface 5 may have one or more buttons to adjust the current height of work surface 3. For example, control interface 5 as shown in the front view 200C (FIG. 2C) of working body 2 may have one or more of a lift button, a lower button, a lock/un-lock button, a memory button designating a user's preferred current height, and/or one or more other buttons used to control, adjust, and/or otherwise operate the current height of work surface 3.

In some implementations, the one or more cavities of work surface support structure 4 of working body 2 may be referred to as openings, orifices, chambers, cutouts, mortices, voids, vacant volumes, and/or other terminology to indicate useable spaces within work surface support structure 4. In some implementations, front facing center cavity 8*a* may contain a center tray 9. By way of non-limiting example, center tray 9 may be inserted and/or withdrawn from front facing center cavity 8*a*. In some implementations, front facing adjacent cavity 8*b* may contain a side tray 7. By way of non-limiting example, side tray 7 may be inserted and/or withdrawn from front facing adjacent cavity 8*b*.

In some implementations, the cavities of work surface support structure 4 may contain other desk attachments and/or components other than trays. By way of non-limiting example, the cavities may include storage areas, keyboard and mouse housing, open-faced cavities, and/or other cavity functions.

Figure 2A:
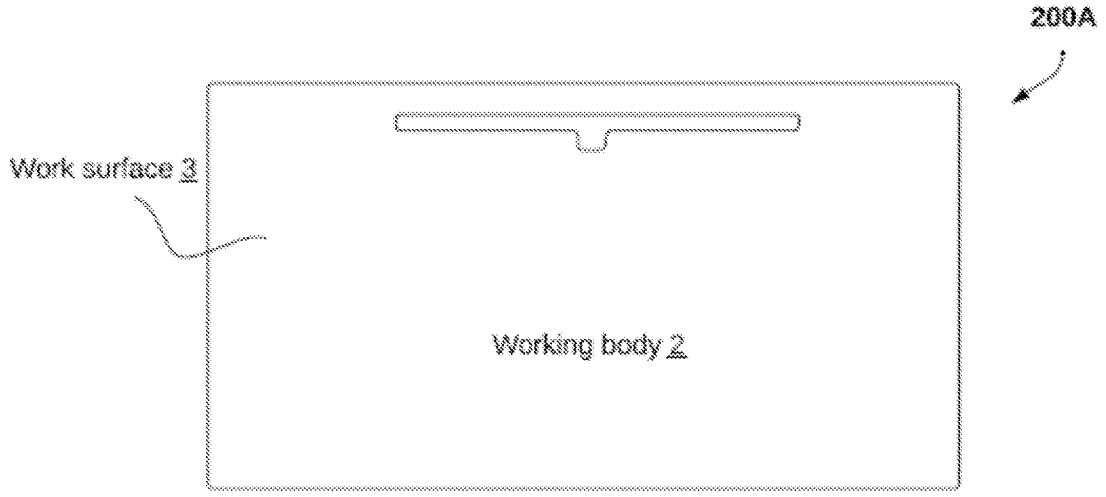
FIG. 2A shows a top view 200A of a working body, in accordance with one or more implementations.
Figure 2B:
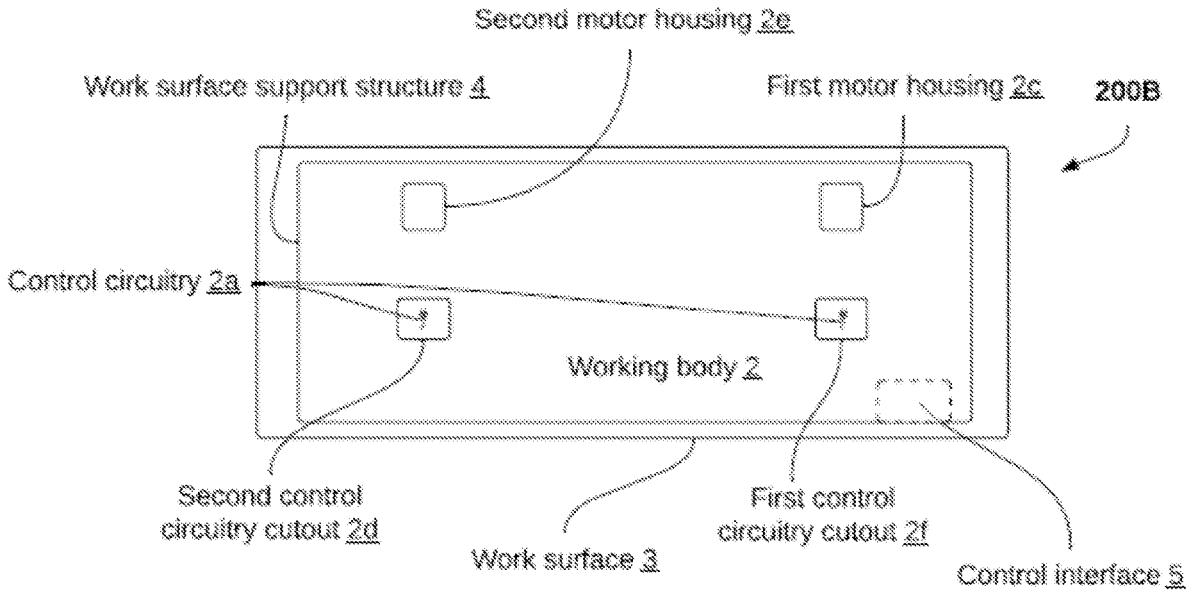
FIG. 2B shows a bottom view 200B of a working body, in accordance with one or more implementations.
Figure 2C:
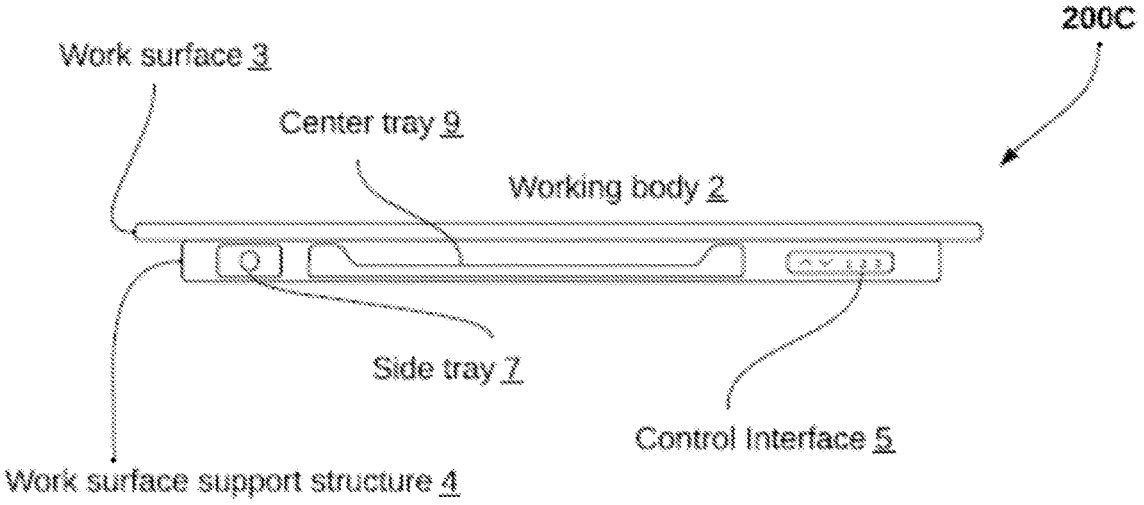
FIG. 2C shows a front view 200C of a working body, in accordance with one or more implementations.

FIG. 2A shows a top view 200A of a working body 2. By way of non-limiting example, FIG. 2B shows a bottom view 200B of working body 2 and may include a first motor housing 2*c* positioned at the rear of work surface support structure 4. The bottom of working body 2 may include a second motor housing 2*e*, positioned opposite of first motor housing 2*c* and at the rear of work surface support structure 4.

Referring to bottom view 200B of FIG. 2B, working body 2 may include a control circuitry 2*a*, a first control circuitry cutout 2*f*, a second control circuitry cutout 2*d*, and/or other components. In some implementations, control circuitry 2*a* may be configured to detect user input received by control interface 5. Responsive to the detection of the user input, first lifting mechanism 31 may be controlled to either lift working body 2 and increase the current height of work surface 3 or lower working body 2 and decrease the current height of work surface 3. Responsive to the detection of the user input, second lifting mechanisms 32 may be controlled to either lift working body 2 and increase the current height of work surface 3 or lower working body 2 and decrease the current height of work surface 3, e.g., in synchrony with lifting mechanism 31.

In some implementations, first control circuitry cutout 2*f* (e.g., orifice, chamber, opening, mortice, void, vacant volume) may be configured to allow users to easily access and connect control circuitry 2*a* to first lifting mechanism 31 (FIG. 1A) when first lifting mechanism 31 (FIG. 1A) is adjustably coupled to working body 2.

In some implementations, second control circuitry cutout 2*d* (e.g., orifice, chamber, opening, mortice, void, vacant volume) may be configured to allow users to easily access and connect control circuitry 2*a* to second lifting mechanism 32 (FIG. 1A) when second lifting mechanism 32 (FIG. 1A) is adjustably coupled to working body 2.

Figure 1D:
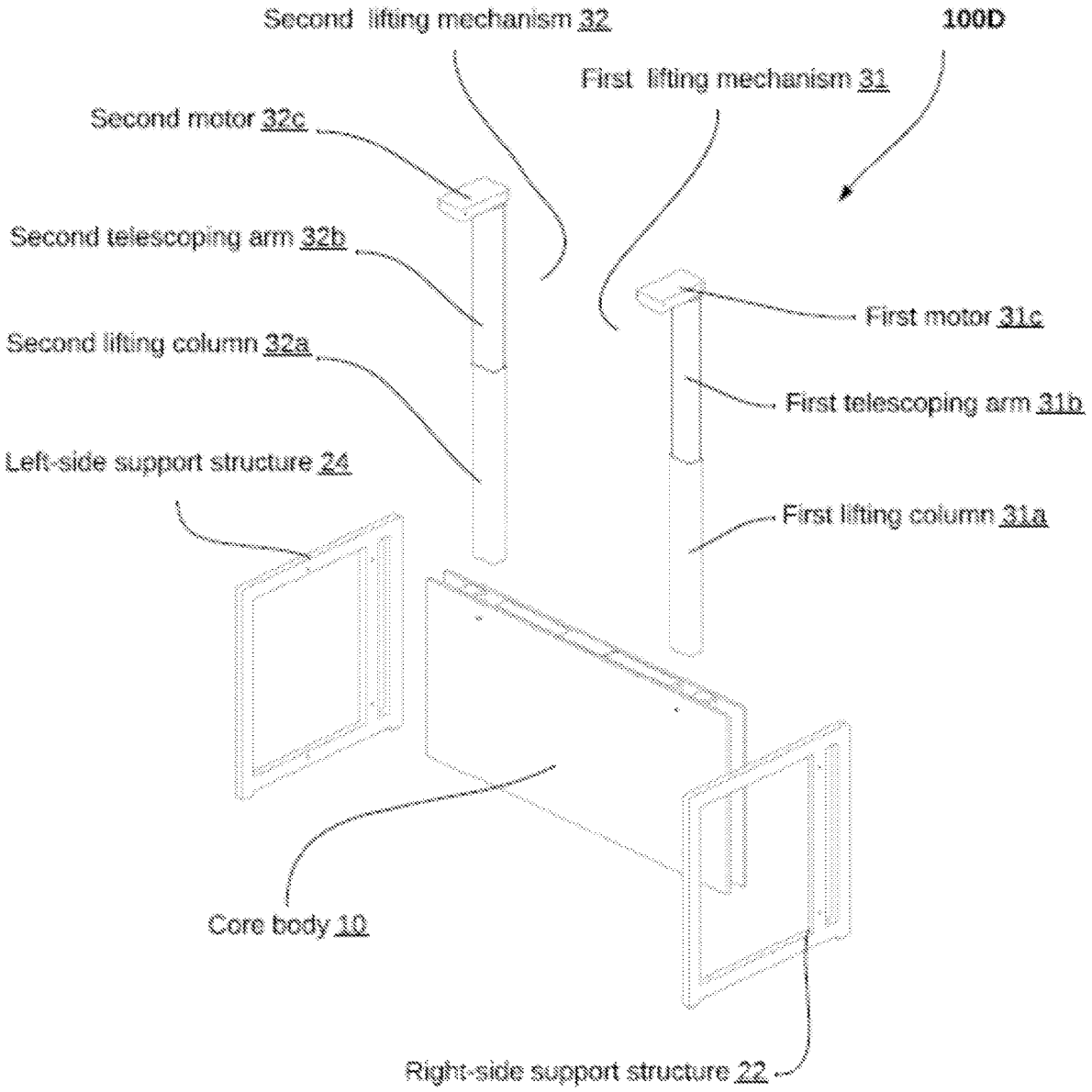
FIG. 1D shows a disassembled and/or exploded view of a core body, a first lifting mechanism, a second lifting mechanism, a left-side support structure, and a right-side support structure, in accordance with one or more implementations.

In some implementations, first motor housing 2*c* may be coupled to a first motor 31*c* (FIG. 1D) of first lifting mechanism 31 (FIG. 1D). Second motor housing 2*e* may be coupled to a second motor 32*c* (FIG. 1D) of second lifting mechanism 32 (FIG. 1D).

Figure 2D:
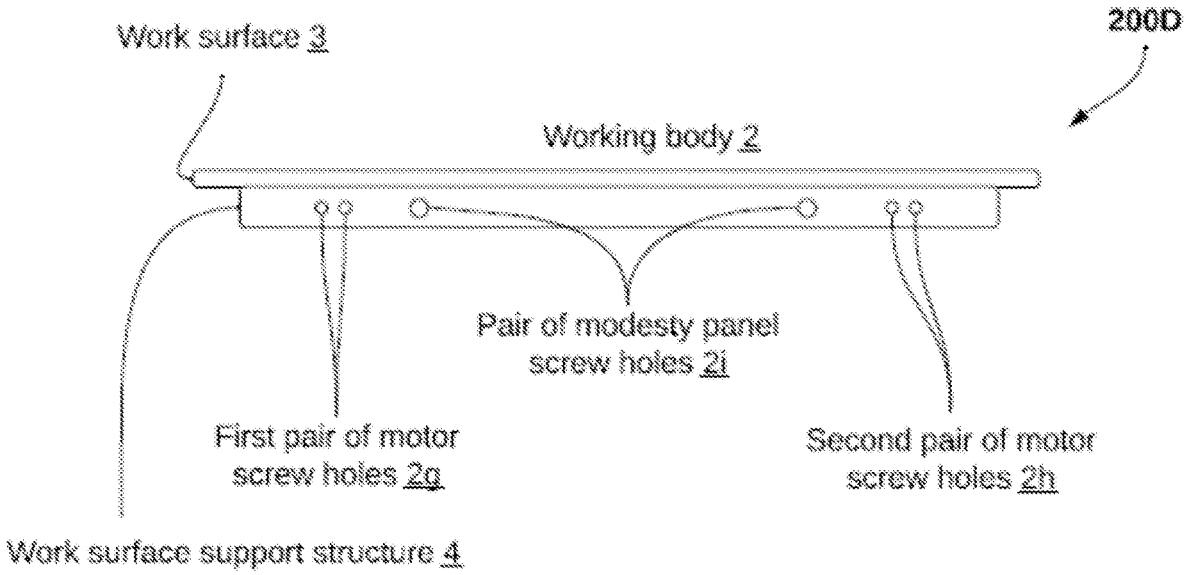
FIG. 2D shows a rear view 200D of a working body, in accordance with one or more implementations.

Referring to FIG. 2D, a rear view 200D of working body 2 shows a first pair of motor screw holes 2*g*, a second pair of motor screw holes 2*h*, a pair of modesty panel screw holes 2*i*, and/or other components. First pair of motor screw holes 2*g* may be configured to include one or more screws, nuts, bolts, pins, and/or one or more other fastening hardware or fasteners to secure/fasten first motor 31*c* (FIG. 1D) of first lifting mechanism 31 (FIG. 1D) to first motor housing 2*c* (FIG. 2B) of working body 2. Second pair of motor screw holes 2*h* may be configured to include one or more of screws, nuts, bolts, pins, and/or one or more other fastening hardware or fasteners to secure/fasten second motor 32*c* (FIG. 1D) of second lifting mechanism 32 (FIG. 1D) to second motor housing 2*e* (FIG. 2B) of working body 2.

Core body 10 may be disposed vertically at a rear side of desk 100 with respect to work surface 3 of desk 100. Core body 10 may extend laterally between the left side and the right side of the desk. Core body 10 may be coupled to left-side support structure 24 (FIG. 1A) and coupled to right-side support structure 22 (FIG. 1A). Core body 10 may house first lifting mechanism 31 (FIG. 1A) and second lifting mechanism 32 (FIG. 1A). In some implementations, core body 10 (apart from first lifting mechanism 31 and second lifting mechanism 32) may be stationary relative to first lifting mechanism 31 and second lifting mechanism 32 during adjustments of the current height of the work surface 3.

Figure 1E:
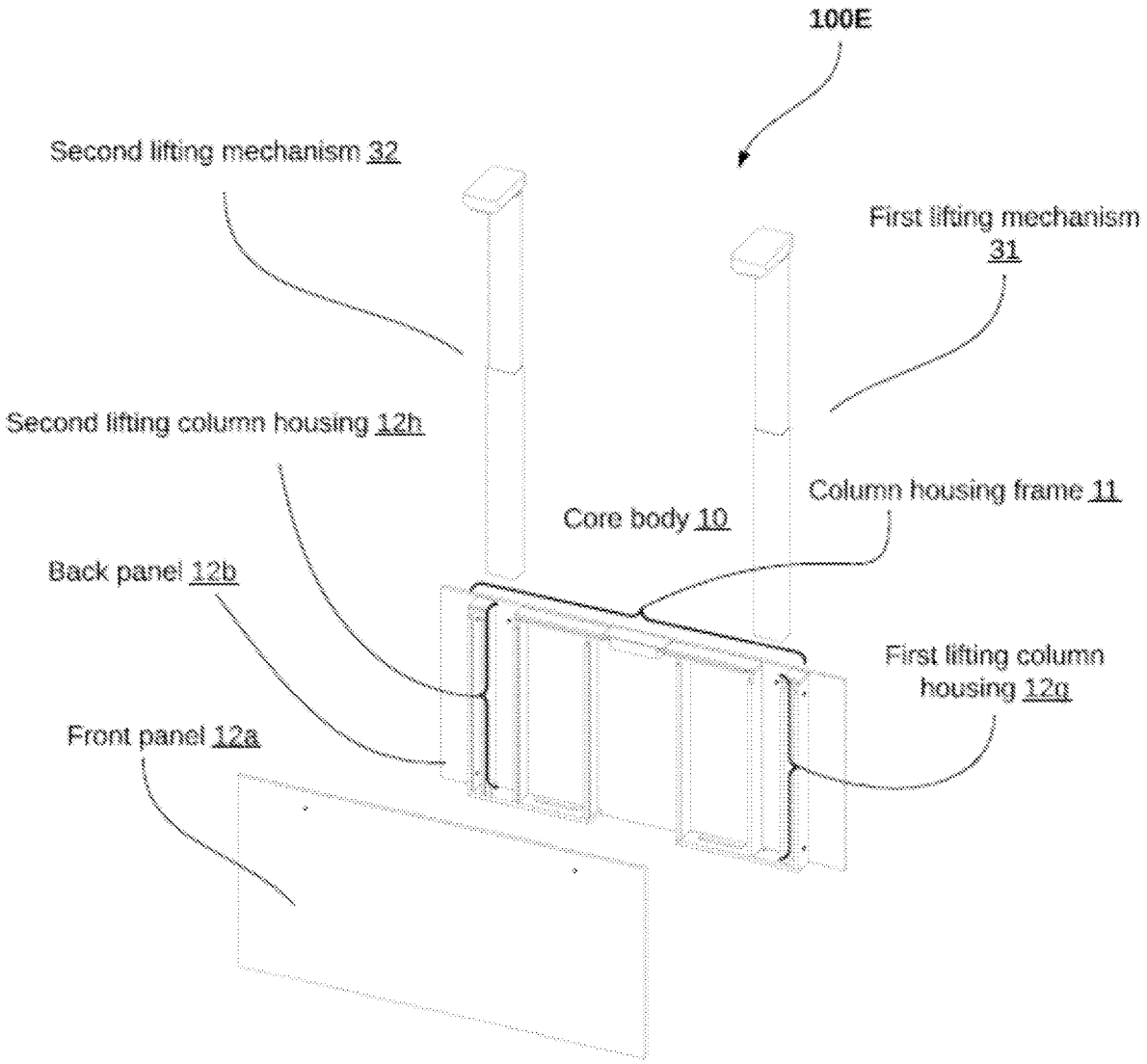
FIG. 1E shows a disassembled and/or exploded view of a core body, a first lifting mechanism, and a second lifting mechanism, in accordance with one or more implementations.

Referring to the core body exploded view 100E of FIG. 1E and by way of non-limiting example, core body 10 may be configured to include one or more of a column housing frame 11, a front panel 12*a*, a back panel 12*b*, a first lifting column housing 12*g*, a second lifting column housing 12*h*, and/or one or more other components. In some implementations, column housing frame 11 may have a front face, a rear face, a left face, and a right face. Column housing frame 11 may be configured to house first lifting column 31*a* and second lifting column 32*a*.

Figure 3A:
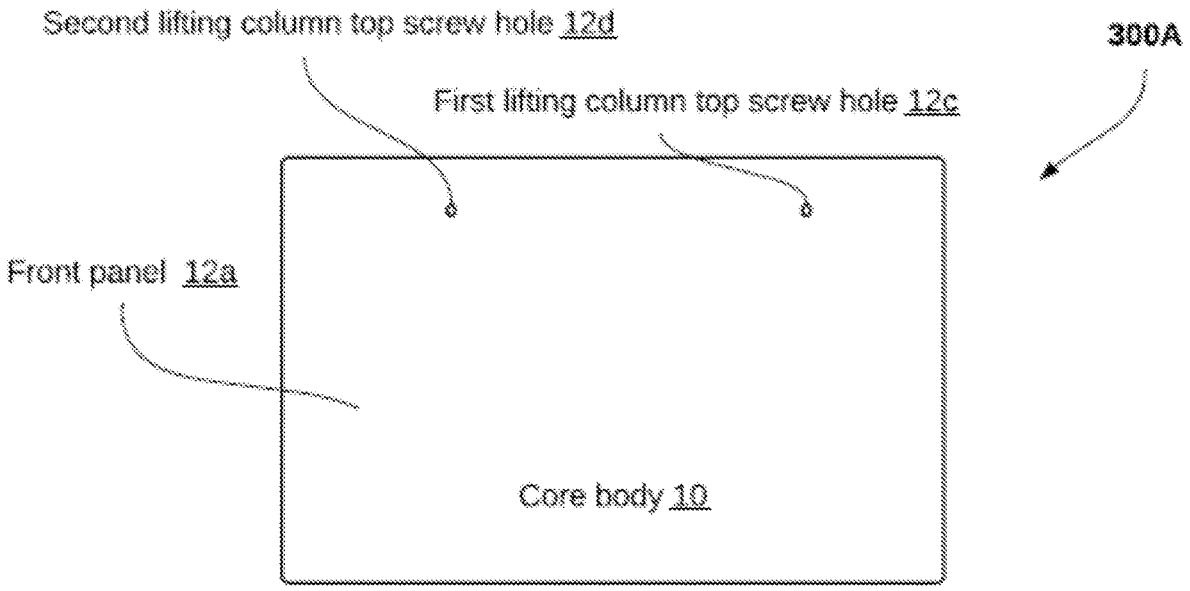
FIG. 3A shows a front view 300A of a core body, in accordance with one or more implementations.
Figure 3B:
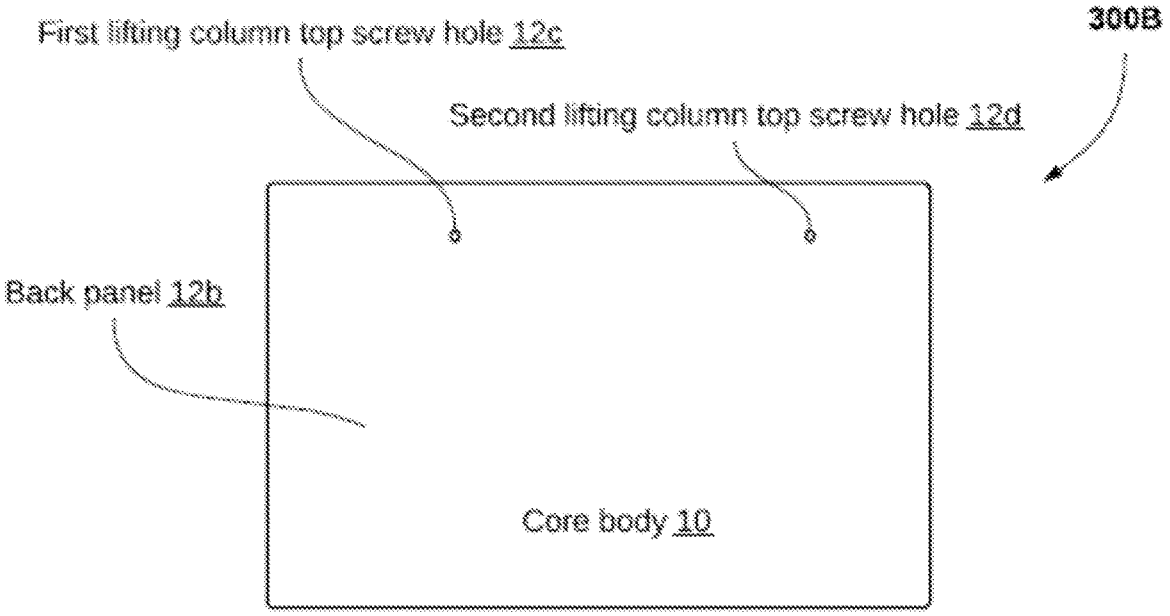
FIG. 3B shows a rear view 300B of a core body, in accordance with one or more implementations.

FIG. 3A shows a core body front view 300A. FIG. 3B shows a core body rear view 300B. In some implementations, front panel 12*a* (see FIG. 3A) and back panel 12*b* (see FIG. 3B) of core body 10 may include a first lifting column top screw hole 12*c* and a second lifting column top screw hole 12*d*. First lifting column top screw hole 12*c* may be configured to secure first lifting column 31*a* (FIG. 1D) to core body 10. Second lifting column top screw hole 12*d* may be configured to secure second lifting column 32*a* (FIG. 1D) to core body 10.

Figure 3C:
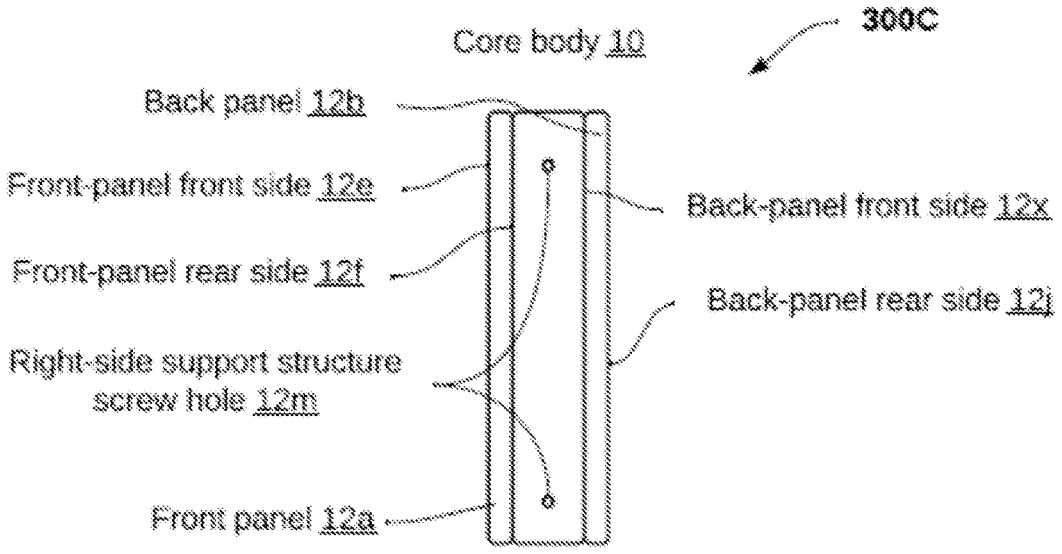
FIG. 3C shows a right-side view 300C of a core body, in accordance with one or more implementations.
Figure 3D:
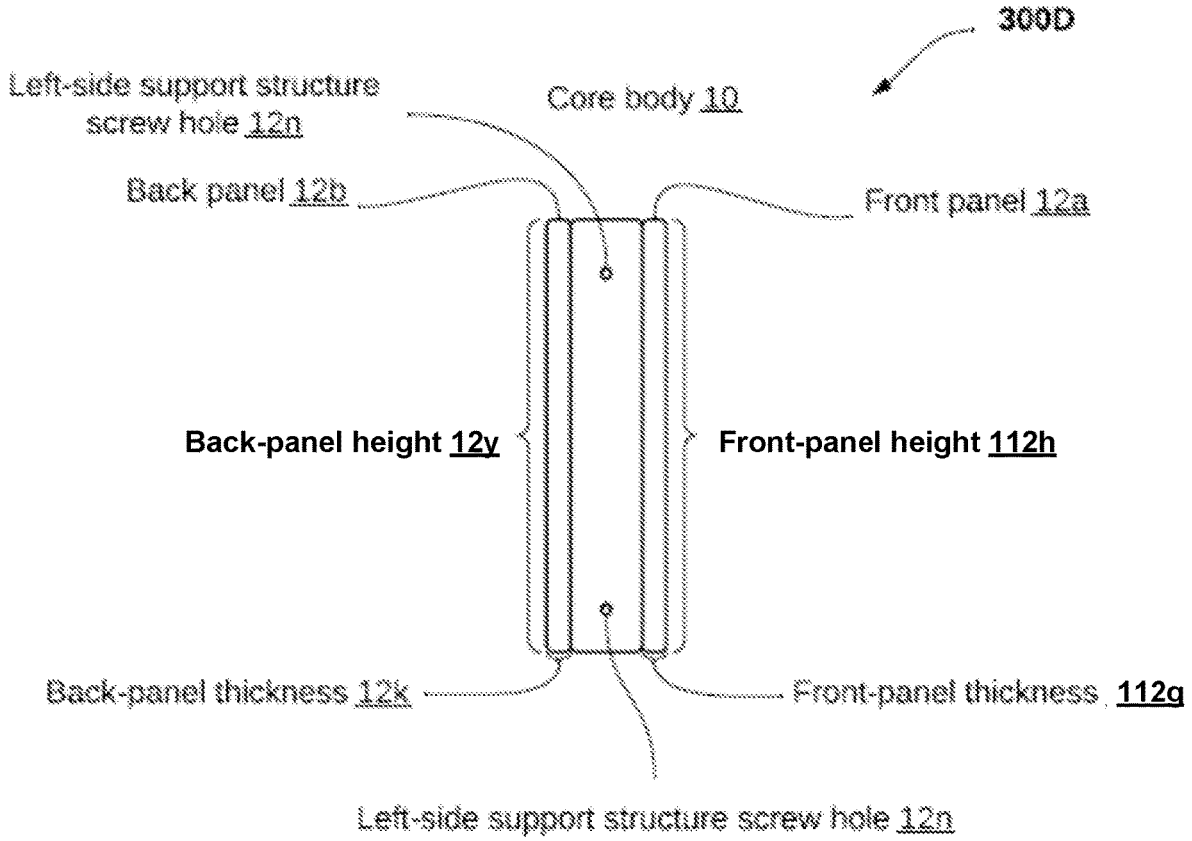
FIG. 3D shows a left-side view 300D of a core body, in accordance with one or more implementations.
Figure 4A:
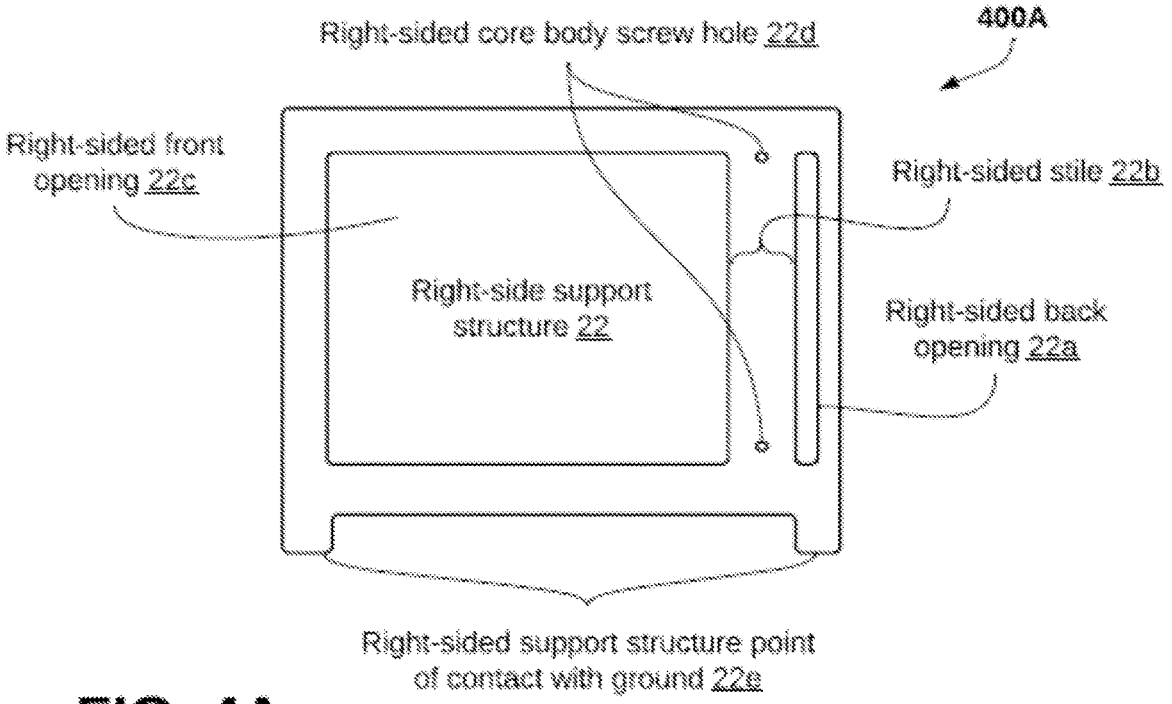
FIG. 4A shows an outside view 400A of a right-side support structure, in accordance with one or more implementations.

FIG. 3C shows a right-side view 300C of core body 10. FIG. 3D shows a left-side view 300D of core body 10. In some implementations, back panel 12*b* may include a back-panel front side 12*x* (FIG. 3C), and a back-panel rear side 12*j* (FIG. 3C). Back-panel front side 12*x* (FIG. 3C) of back panel 12*b* may be coupled to the rear of column housing frame 11 (FIG. 1E). Back panel 12*b* may be configured to provide support for core body 10 by being inserted into a left-sided back opening 24*a* (FIG. 4C) of left-side support structure 24 (FIG. 4C) and a right-sided back opening 22*a* (FIG. 4A) of right-side support structure 22 (FIG. 4A). In some implementations, back panel 12*b* may include a back-panel height 12*y* (FIG. 3D), and a back-panel thickness 12*k* (FIG. 3D).

In some implementations, front panel 12*a* may include a front-panel front side 12*e* (FIG. 3C) and a front-panel rear side 12*f* (FIG. 3C). Front-panel rear side 12*f* (FIG. 3C) of front panel 12*a* may be coupled to the front of housing frame 11 (FIG. 1E). Front panel 12*a* may be configured to provide support for core body 10 by being inserted into left-sided front opening 24*c* (FIG. 4C) of left-side support structure 24 (FIG. 4C) and right-sided front opening 22*c* (FIG. 4A) of right-side support structure 22 (FIG. 4A). In some implementations, front panel 12*a* may include front-panel height 112*h* (FIG. 3D) and a front-panel thickness 112*g* (FIG. 3D).

Figure 3E:
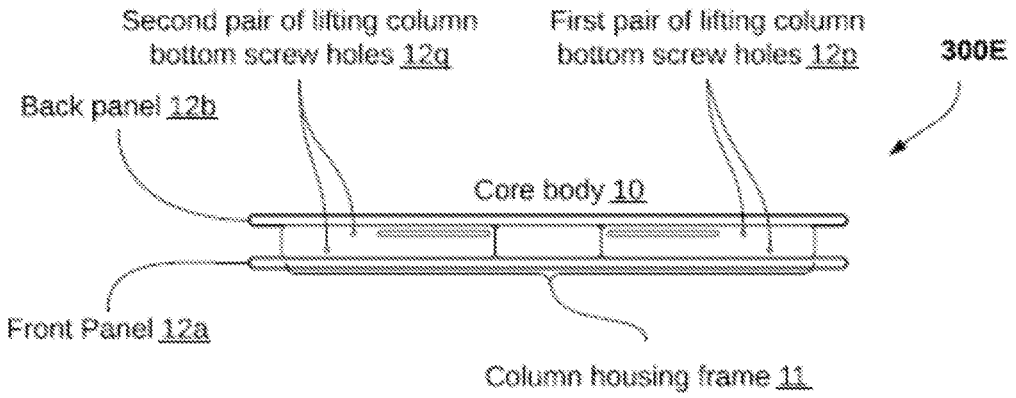
FIG. 3E shows a bottom view 300E of a core body, in accordance with one or more implementations.
Figure 3F:
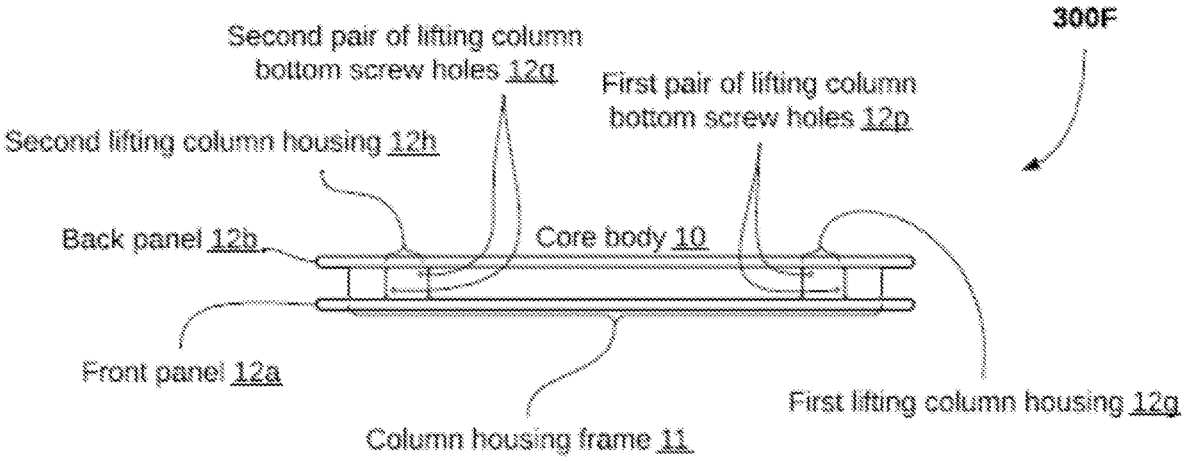
FIG. 3F shows a top view 300F of a core body, in accordance with one or more implementations.

FIG. 3E shows a bottom view 300E of core body 10, including a first pair of lifting column bottom screw holes 12*p*, a second pair of lifting column bottom screw holes 12*q*, and/or other components. First pair of lifting column bottom screw holes 12*p* may be configured to include one or more screws, nuts, bolts, pins, and/or one or more other fastening hardware or fasteners to secure/fasten first lifting column 31*a* (FIG. 1D) of first lifting mechanism 31 (FIG. 1D) to first lifting column housing 12*g* (FIG. 1E) of core body 10. Second pair of lifting column screw holes 12*q* may be configured to include one or more of screws, nuts, bolts, pins, and/or one or more other fastening hardware or fasteners to secure/fasten second lifting column 32*a* (FIG. 1D) of second lifting mechanism 32 (FIG. 1D) to second lifting column housing 12*h* (FIG. 1E) of core body 10.

In some implementations, first lifting mechanism 31 may be coupled to core body 10 by first lifting column 31*a* (FIG. 1D) being inserted into first lifting column housing 12*g* (FIG. 1E). In some implementations, second lifting mechanism 32 may be coupled to core body 10 by second lifting column 32*a* (FIG. 1D) being inserted into second lifting column housing 12*h* (FIG. 1E).

Figure 4B:
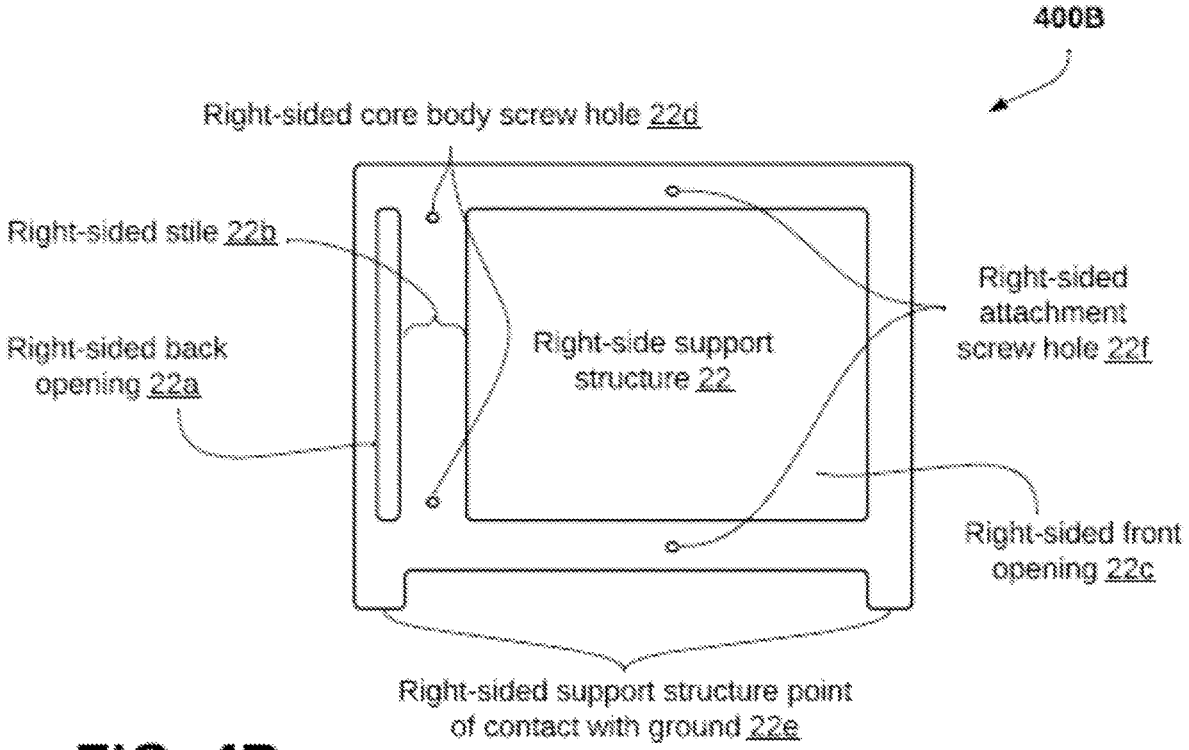
FIG. 4B shows an inside view 400B of a right-side support structure, in accordance with one or more implementations.
Figure 4C:
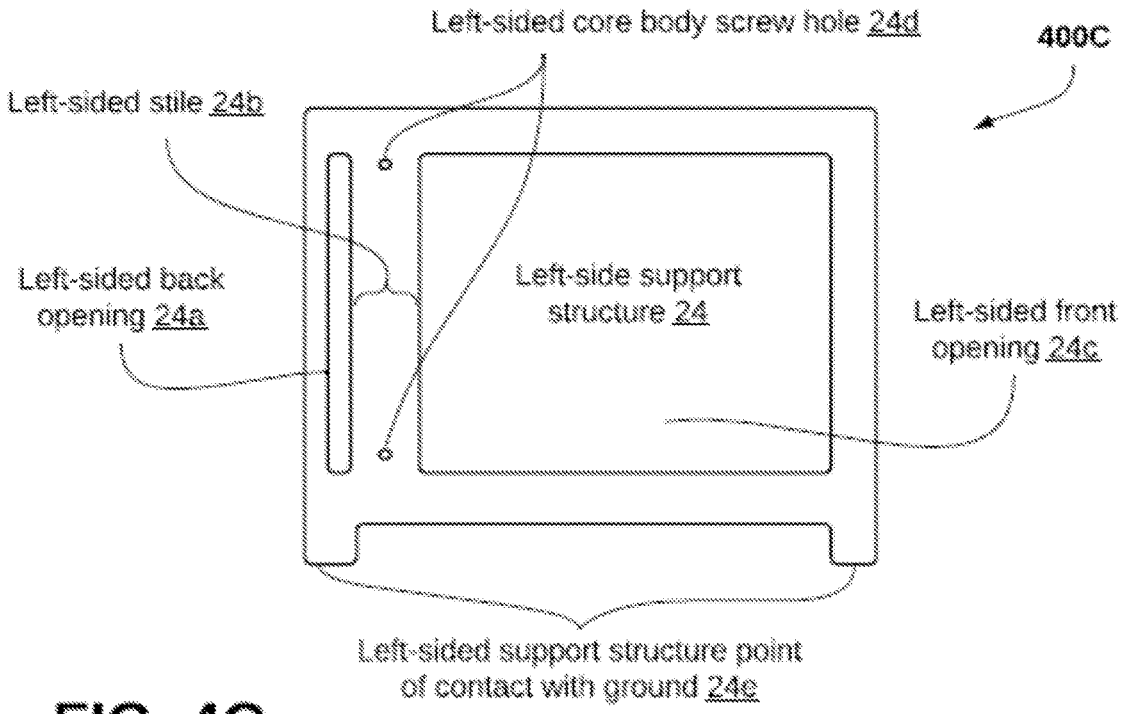
FIG. 4C shows an outside view 400C of a left-side support structure, in accordance with one or more implementations.

By way of non-limiting example, both views 300E and 300F show a length of front panel 12*a* and a length of back panel 12*b*, each of which may be greater than a length of column housing frame 11. In some implementations, the extra length of the front panel 12*a* may be configured to be inserted into a right-sided front opening 22*c* (FIG. 4A) and left-sided front opening 24*c* (FIG. 4C). In some implementations, the extra length of the back panel 12*b* may be configured to be inserted into right-sided back opening 22*a* (FIG. 4A) and left-sided back opening 24*a* (FIG. 4C).

Referring back to FIG. 1D, first lifting mechanism 31 may include one or more of first motor 31*c*, a first telescoping arm 31*b*, first lifting column 31*a*, and/or other components. In some implementations, first lifting mechanism 31 may have at least two stages. Second lifting mechanism 32 may include one or more of second motor 32*c*, a second telescoping arm 32*b*, second lifting column 32*a*, and/or other components. In some implementations, second lifting mechanism 32 may have at least two stages. In some implementations, first and second telescoping arms (31*b*, 32*b*) are the only visibly moving parts of the entire desk when the desk is being lifted and/or lowered (during use, after assembly).

In some implementations, first lifting mechanism 31 may include a first mechanical linear actuator. Second lifting mechanism 32 may include a second mechanical linear actuator. Controlling first and second lifting mechanisms (31, 32) may include controlling the first mechanical linear actuator and the second mechanical linear actuator in synchrony.

Referring back to FIG. 1A, left-side support structure 24 may be disposed at a left side of desk 100 with respect to work surface 3 of working body 2. In some implementations, left-side support structure 24 may be stationary during adjustments of the current height of work surface 3.

Figure 4D:
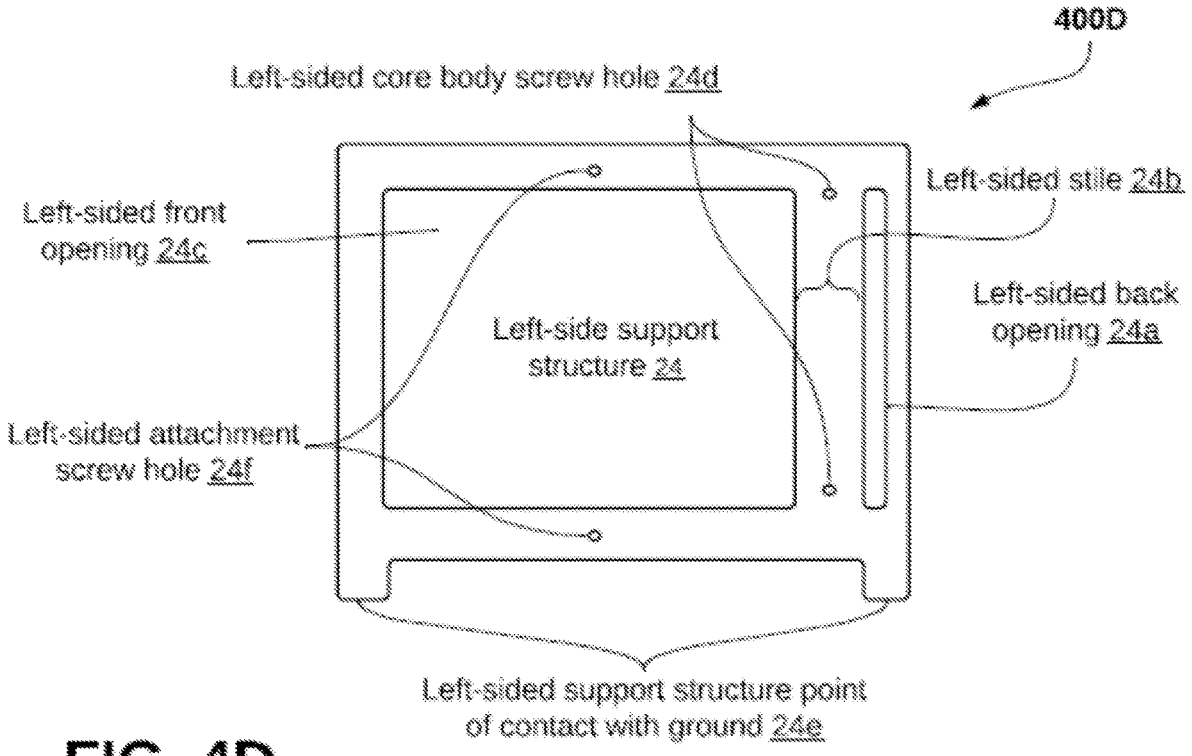
FIG. 4D shows an inside view 400D of a left-side support structure, in accordance with one or more implementations.

FIG. 4D shows an inside view 400D of left-side support structure 24. FIG. 4C shows an outside view 400C of left-side support structure 24. In some implementations, left-side support structure 24 may include left-sided back opening 24*a* and a left-sided front opening 24*c* in front of left-sided back opening 24*a*.

Left-sided back opening 24*a* of left-side support structure 24 may be configured to include a first width at least as wide as back-panel thickness 12*k* (FIG. 3D) and a first height at least as long as back-panel height 12*y* (FIG. 3D). In some implementations, left-side support structure 24 may be configured to include a left-sided stile 24*b*, disposed between left-sided back opening 24*a* and left-sided front opening 24*c*. Left-sided stile 24*b* may be configured to have a width less than a distance between back-panel front side 12*x* (FIG. 3C) and front-panel rear side 12*f* (FIG. 3C). By way of non-limiting example, left-sided stile 24*b* of left side support structure 24 may be identified as one or more of a left-sided post, a left-sided connector, a left-sided closing, a left-sided panel, a left-sided member, and/or other terms that properly identify 24*b*.

In some implementations, left-side support structure 24 may be configured to include a left-sided front opening 24*c* comprised of a width and a height. In some implementations, the width of left-sided front opening 24*c* may be in the range of 80%-95% of a width of left-side support structure 24. In some implementations, the width of left-sided front opening 24*c* may be in the range of 70%-85% of a width of left-side support structure 24. In some implementations, the width of left-sided front opening 24*c* may be in the range of 60%-80% of a width of left-side support structure 24, as depicted in FIG. 4A. In some implementations, the height of left-sided front opening 24*c* may be in the range of 80%-95% of a height of left-side support structure 24. In some implementations, the height of left-sided front opening 24*c* may be in the range of 70%-85% of a height of left-side support structure 24. In some implementations, the height of left-sided front opening 24*c* may be in the range of 60%-80% of a height of left-side support structure 24, as depicted in FIG. 4A.

In some implementations, a shape of left-side support structure 24 as viewed from the left side of desk 100 may be a rectangular shape. By way of non-limiting illustration, the shape of left-side support structure 24 as viewed from the left side of desk 100 may be one or more of a circle, triangle, and/or other geometric shapes. It is noted that a difference in the shape of the left-side support structure as viewed from the left side may change many other components of desk 100. In implementations where a side support structure would have a different shape than depicted, the same manner of coupling components together would be retained so that working body 2 would be lifted and/or lowered by lifting mechanisms positioned at its rear and having support structures on the side of desk 100.

Referring back to FIG. 1A, right-side support structure 22 may be disposed at a right side of desk 100 with respect to work surface 3 of working body 2. In some implementations, right-side support structure 22 may be stationary during adjustments of the current height of work surface 3.

FIG. 4A shows an outside view 400A of right-side support structure 22. FIG. 4B shows an inside view 400B of right-side support structure 22. In some implementations right-side support structure 22 may include right-sided back opening 22*a* and a right-sided front opening 22*c* in front of right-sided back opening 22*a*.

Right-sided back opening 22*a* of right-side support structure 22 may be configured to include a first width at least as wide as a back-panel thickness 12*k* (FIG. 3D) and a first height at least as long as a back-panel height 12*y* (FIG. 3D). In some implementations, right-side support structure 22 may be configured to include a right-sided stile 22*b*, disposed between right-sided back opening 22*a* and right-sided front opening 22*c*. Right-sided stile 22*b* may be configured to have a width less than a distance between back-panel front side 12*x* (FIG. 3C) and front-panel rear side 12*f* (FIG. 3C). By way of non-limiting example, right-sided stile 22*b* of right-side support structure 22 may be identified as one or more of a right-sided post, a right-sided connector, a right-sided closing, a right-sided panel, a right-sided member, and/or other terms that properly identify 22*b*.

In some implementations, right-side support structure 22 may be configured to include right-sided front opening 22*c* comprised of a width and a height. The width of right-sided front opening 22*c* may be in the range of 80%-95% of a width of right-side support structure 22. In some implementations, the width of right-sided front opening 22*c* may be in the range of 70%-85% of a width of right-side support structure 22. In some implementations, the width of right-sided front opening 22*c* may be in the range of 60%-80% of a width of right-side support structure 22, as depicted in FIG. 4C. In some implementations, the height of right-sided front opening 22*c* may be in the range of 80%-95% of a height of right-side support structure 22. In some implementations, the height of right-sided front opening 22*c* may be in the range of 70%-85% of a height of right-side support structure 22. In some implementations, the height of right-sided front opening 22*c* may be in the range of 60%-80% of a height of right-side support structure 22, as depicted in FIG. 4C.

In some implementations, a shape of the right-side support structure 22 as viewed from the right side of desk 100 may be a rectangular shape. By way of non-limiting illustration, the shape of the right-side support structure 22 as viewed from the right side of desk 100 may be one or more of a circle, triangle, and/or other geometric shapes. It is noted that a difference in the shape of the right-side support structure as viewed from the right side may change many other components of desk 100. In implementations where a side support structure would have a different shape than depicted, the same manner of coupling components together would be retained so that working body 2 would be lifted and/or lowered by lifting mechanisms positioned at its rear and having support structures on the side of desk 100.

In some implementations, right-side support structure 22 and left-side support structure 24 may have attachment screw holes as shown by 22*f* (FIG. 4B, 400B) and 24*f* (FIG. 4D, 400D) configured to support the coupling of interchangeable desk attachments. By way of non-limiting example, interchangeable desk attachments may be one or more of extra storage, shelves, waste receptacles, file organizers, water coolers, plant pots, desk extension platforms, and/or other attachments to further customize the desk to satisfy a user's desires.

In some implementations, right-side support structure 22 and left-side support structure 24 may fully support working body 2 and core body 10. In some implementations, each support structure may have one point of contact with the ground. In some implementations, each support structure may have at least two points of contact with the ground. By way of non-limiting example, there may be one or more left-sided support structure points of contact with ground 24*e* (FIG. 4C). Similarly, there may be one or more right-sided support structure points of contact with ground 22*e* (FIG. 4A). In some implementations, by virtue of left-side support structure 22 and right-side support structure 24 fully supporting working body 2 and core body 10, working body 2 and core body 10 do not contact the ground directly.

Figure 5A:
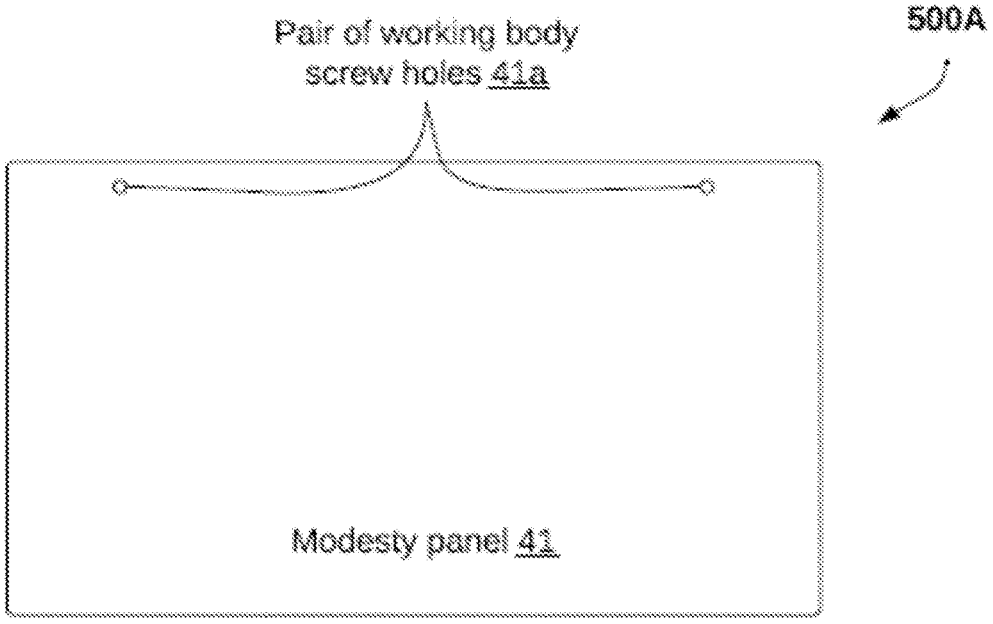
FIG. 5A shows a front view 500A of a modesty panel, in accordance with one or more implementations.
Figure 5B:
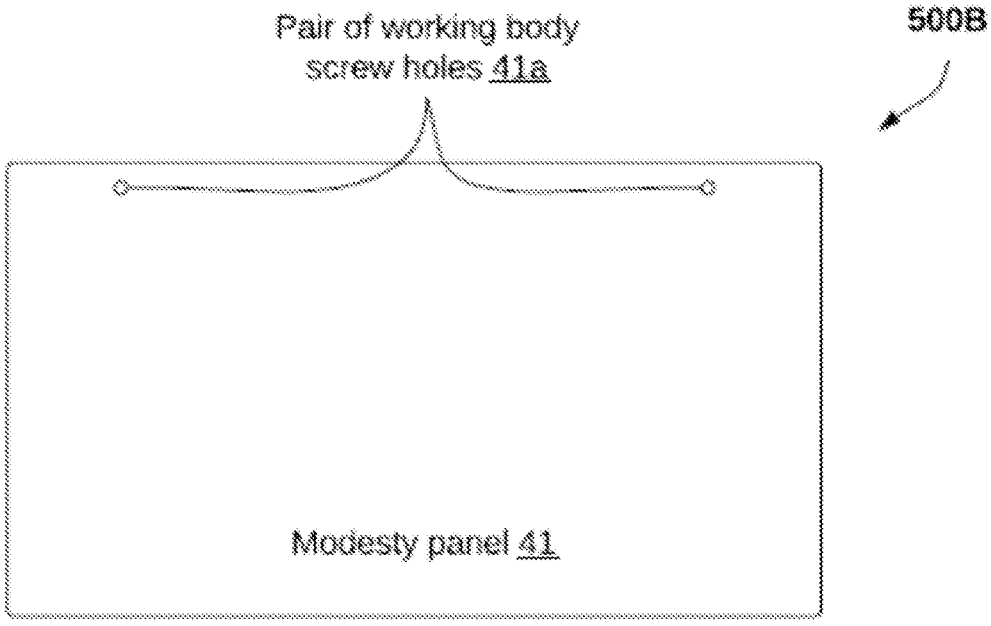
FIG. 5B shows a rear view 500B of a modesty panel, in accordance with one or more implementations.

FIG. 5A shows a front view 500A of a modesty panel 41. FIG. 5B shows a rear view 500B of modesty panel 41. In some implementations, modesty panel 41 may include a pair working body screw holes 41*a*, and/or other components. Pair of working body screw holes 41*a* may facilitate convenient coupling of modesty panel 41 to working body 2 by virtue of one or more screws, nuts, bolts, pins, and/or one or more other fastening hardware or fasteners to secure/fasten objects together. Modesty panel 41 may be configured to move with working body 2 as it is lifted and/or lowered.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A desk configured to be positioned for a user in a sitting position and/or a standing position, the desk having a rear side, a left side, and a right side as viewed by the user, wherein the desk comprises:

a working body that provides a work surface of the desk, wherein the work surface is disposed at a current height, wherein the current height is adjustable;

a left-side support structure disposed at the left side of the desk, wherein the left-side support structure supports at least part of the desk, and wherein the left-side support structure is stationary during adjustments of the current height of the work surface;

a right-side support structure disposed at the right side of the desk, wherein the right-side support structure supports at least part of the desk, and wherein the right-side support structure is stationary during the adjustments of the current height of the work surface;

a core body disposed vertically at the rear side of the desk, wherein the core body is coupled to the left-side support structure and coupled to the right-side support structure, wherein the core body houses at least part of one or more lifting mechanisms, wherein the core body is stationary during the adjustments of the current height of the work surface except for the one or more lifting mechanisms; and a control interface configured to receive user input from the user; and control circuitry configured to:

(i) detect the user input received by the control interface; and (ii) responsive to detection of the user input, control the one or more lifting mechanisms to either (a) lift the working body and increase the current height of the work surface, or (b) lower the working body and decrease the current height of the work surface.

2. The desk of claim 1, wherein the one or more lifting mechanisms include multiple mechanical linear actuators, and wherein controlling the one or more lifting mechanisms includes controlling the multiple mechanical linear actuators in synchrony.

3. The desk of claim 2, wherein the one or more lifting mechanisms further include a first motor, and wherein the working body includes a first housing configured to house the first motor.

4. The desk of claim 2, wherein the one or more lifting mechanisms further include a first lifting column and a first telescoping arm, and wherein the one or more lifting mechanisms have at least two stages.

5. The desk of claim 4, wherein the left-side support structure includes a left-sided back opening, wherein the right-side support structure includes a right-sided back opening, wherein the left-side support structure includes a left-sided front opening in front of the left-sided back opening, wherein the right-side support structure includes a right-sided front opening in front of the right-sided back opening, and wherein the core body includes:

a column housing frame having a front face, a rear face, a left face, and a right face, configured to house the first lifting column;

a back panel having a front side, rear side, a height, and back-panel thickness, wherein the front side of the back panel is coupled to the rear face of the column housing frame, and configured to provide support for the core body by being inserted into the left-sided back opening of the left-side support structure and the right-sided back opening of the right-side support structure; and a front panel having a front side, rear side, a height, and front-panel thickness, wherein the rear side of the front panel is coupled to the front face of the column housing frame, and configured to provide support for the core body by being inserted into the left-sided front opening of the left-side support structure and the right-sided front opening of the right-side support structure.

6. The desk of claim 5, wherein the left-sided back opening of the left-side support structure further includes a first width at least as wide as the back-panel thickness and a first height at least as long as the back-panel height, and wherein the right-sided back opening of the right-side support structure further includes a second width at least as wide as the back-panel thickness and a second height at least as long as the back-panel height.

7. The desk of claim 5, wherein the left-side support structure further includes a left stile disposed between the left-sided back opening and the left-sided front opening, wherein the left stile has a width less than a distance between the front side of the back panel and the rear side of the front panel, wherein the right-side support structure further includes a right stile disposed between the right-sided back opening and the right-sided front opening, and wherein the right stile has a width less than the distance between the front side of the back panel and the rear side of the front panel.

8. The desk of claim 5, wherein the left-sided front opening of the left-side support structure further includes a width and a height, wherein the width of the left-sided front opening ranges between 80% and 95% of a width of the left-side support structure, and wherein the height of the left-sided front opening ranges between 80% and 95% of a height of the left-side support structure, and wherein the right-sided front opening of the right-side support structure further includes a width and a height, wherein the width of the right-sided front opening ranges between 80% and 95% of the width of the right-side support structure, and wherein the height of the right-sided front opening ranges between 80% and 95% of the height of the right-side support structure.

9. The desk of claim 1, wherein a shape of the left-side support structure as viewed from the left side of the height-adjustable desk is a rectangular shape, and wherein a shape of the right-side support structure as viewed from the right side of the height-adjustable desk is a rectangular shape.

10. The desk of claim 1, wherein the left-side support structure and the right-side support structure fully support the working body and the core body, and wherein the working body and the core body do not contact the ground directly.

11. The desk of claim 1, wherein the working body includes a modesty panel vertically coupled to the rear of the working body, and wherein the modesty panel moves with the working body when the working body is lifted or lowered.

12. The desk of claim 1, wherein the working body includes:

a work surface support structure, wherein the work surface support structure contains one or more cavities;

a front facing center cavity, wherein the front facing center cavity contains a center tray such that the center tray can be inserted and/or withdrawn from the front facing center cavity; and a front facing adjacent cavity, wherein the front facing adjacent cavity contains a side tray such that the side tray can be inserted and/or withdrawn from the front facing adjacent cavity.

13. The desk of claim 1, wherein the work surface of the working body has a surface area ranging from 46 to 52 inches in width and about 26 inches deep.

14. The desk of claim 1, wherein the adjustments in the current height of the work surface have a vertical range of about 20 inches.

15. The desk of claim 1, wherein the control circuitry is integrated permanently into the working body.

16. A desk configured to support adjustments of a work surface of the desk, wherein the height-adjustable desk has a front side, a rear side, a left side, and a right side, wherein the desk comprises:

a working body, a core body, a left-side support structure, a right-side support structure, a control interface, and a control circuitry;

wherein the working body includes the work surface of the desk, wherein the work surface is disposed at a current height, wherein the current height is adjustable;

wherein the working body is configured to:

(i) adjustably couple to the core body at the rear side of the desk, such that the core body remains stationary during the adjustments of the work surface;

wherein the working body includes (a) a work surface support structure, (b) a front facing center cavity, and (c) one or more motor housings;

wherein the core body is disposed vertically at the rear side of the desk, wherein the core body extends laterally between the left side and the right side of the desk, wherein the core body is coupled to the left-side support structure and coupled to the right-side support structure;

wherein the core body includes one or more lifting mechanisms, wherein the one or more lifting mechanisms are adjustably coupled to the working body through the one or more motor housings;

wherein the one or more lifting mechanisms are configured to raise and lower the working body;

wherein the left-side support structure is disposed at the left side of the desk, wherein the left-side support structure supports at least part of the desk, and wherein the left-side support structure is stationary during the adjustments of the work surface;

wherein the right-side support structure is disposed at the right side of the desk, wherein the right-side support structure supports at least part of the desk, and wherein the right-side support structure is stationary during the adjustments of the work surface;

wherein the control interface is configured to receive user input from a user; and wherein the control circuitry is configured to:

(i) control the one or more lifting mechanisms during the adjustments of the work surface;

(ii) make at least two types of detections regarding the user input received by the control interface, wherein the at least two types of detections include a first type of detections and a second type of detections;

(iii) responsive to a first detection of the first type of detections, increase the current height of the work surface; and (iv) responsive to a second detection of the second type of detections, decrease the current height of the work surface.

* * * * *